US005458192A

United States Patent [19]

Hunt

[11] Patent Number: 5,458,192

[45] Date of Patent: Oct. 17, 1995

[54] METHOD FOR EVALUATING ACIDIZING OPERATIONS

[75] Inventor: James L. Hunt, Carrollton, Tex.

[73] Assignee: Halliburton Company, Duncan, Okla.

[21] Appl. No.: 105,857

[22] Filed: Aug. 11, 1993

[51] Int. Cl.[6] ..... E21B 47/00

[52] U.S. Cl. ..... 166/250; 166/307; 73/155; 364/422

[58] Field of Search ..... 166/250, 307, 166/305.1; 73/155; 364/422

[56] References Cited

U.S. PATENT DOCUMENTS 4,423,625 1/1984 Bostic, III et al. ..... 73/155

4,799,157 1/1989 Kucuk et al. ..... 364/422

4,862,962 9/1989 Prouvost et al. ..... 166/250

5,310,002 5/1994 Blauch et al. ..... 166/307

OTHER PUBLICATIONS

SPE Paper No. 17156 titled "Applications of Real-Time Matrix Acidizing Evaluation Method" by L. P. Prouvost and M. J. Economides, 1988.

*Primary Examiner*—William P. Neuder

*Attorney, Agent, or Firm*—Arnold, White & Durkee

[57] ABSTRACT

A real-time matrix evaluation method based on the line-source solution to the radial-flow transient well testing problem. Skin factor is calculated directly from the bottom-hole pressure response based on a number of known input parameters for the well being treated.

7 Claims, 1 Drawing Sheet

METHOD FOR EVALUATING ACIDIZING OPERATIONS

BACKGROUND OF THE INVENTION

The present invention relates generally to improved methods of evaluating the performance of acidizing operations or treatments; and more specifically relates to improved methods for evaluating matrix acidizing operations for facilitating the determination of formation skin factor as a function of time during the conduct of the acidizing operation.

As is known in the industry, a well that is not producing as expected may be subjected to formation damage, and therefore may need stimulation to remove the damage and to increase the well's productivity. One type of treatment used to remove well damage is matrix acidizing. The purpose of matrix acidizing is to remove damage around the immediate area of the wellbore, thus increasing the well's productivity.

During matrix acidizing treatment, fluids are injected into the porous medium of the reservoir at low rates and pressures called "matrix" or "subfracturing" rates. In theory, the injected fluid dissolves some of the porous medium and all of the damaging material, thereby increasing the reservoir's permeability and productivity.

The degree of well damage is measured by the formation "skin factor". The skin factor is proportional to the steady-state pressure difference around a wellbore. A positive skin factor indicates that the well's flow is restricted, while a negative skin factor indicates flow enhancement, which is usually the result of stimulation. The skin factor is a multi-component measurement that takes into account a number of factors that may cause a restriction in well flow. The matrix acidizing process removes damage around the immediate area of the wellbore and thus reduces the part of the skin factor due to formation damage.

It would be desirable to evaluate the effectiveness of the matrix acidizing treatment in increasing a well's productivity. One conventional method of evaluating the effectiveness of a matrix acidizing treatment is to perform pre-treatment and post-treatment well tests. However, such a process is time consuming and expensive, and is not economically justified for most reservoirs.

Several attempts have been made to evaluate the effectiveness of matrix acidizing treatments by monitoring changes in the skin factor in real-time. The ability to monitor changes in skin factor as stimulation is performed helps evaluate whether an adequate fluid volume has been injected, indicates whether there is a need to modify the treatment, and helps to improve future well designs in similar situations.

One previous real-time evaluation method considers each stage of injection or shut-in during the treatment as a short, discrete well test. The transient reservoir pressure response to the injection of fluids is analyzed and interpreted to determine changes in the condition of the wellbore (skin factor) and the formation transmissibility. This method of using analysis of transient reservoir pressure is valid, however, only if the skin factor is not changing while a set of pressure data for one particular interpretation is being collected. However, injecting reactive fluids into the formation to remove damage causes the skin factor to change constantly during the operation thus rendering erroneous measurements. Hence, in order to be theoretically correct, this method requires the injection of a slug of inert fluid into the formation to generate the transient response for a constant skin factor each time the damage removal is assessed. The injection of inert fluid prior to each assessment is not practical and thus renders this method unworkable in the real world.

Another previous method uses instantaneous pressure and rate values to compute the skin factor at any given time during the treatment. The method, based on the steady-state, single-phase, radial version of Darcy's law, uses the concept of a finite radius "acid bank". This method relies on the assumption that the well is maintained at a "steady-state". This assumption may yield erroneous results since transient behavior is in effect for a time that greatly exceeds injection time. Thus, transient bottomhole pressure or unintentional changes in the injection rate are subject to being misconstrued as changes in skin factor.

A third prior art method involves using the rate history during a treatment and calculating the corresponding bottomhole pressure response for a constant value of skin factor. The difference between the simulated bottomhole pressure response and the bottomhole pressure response measured during the treatment is interpreted as resulting from the instantaneous pressure arising from the skin factor. The skin factor is calculated from this pressure difference and presented as a plot of skin factor versus time.

This evaluation method has several drawbacks. The major drawback is that the values of the well and reservoir parameters required for the simulated pressure response are not generally available. Thus, for matrix acidizing treatments an injection/falloff test must be performed prior to evaluation to obtain these values. Performing an injectivity/falloff test prior to the matrix acidizing treatment to determine permeability and skin factor from the falloff data analysis involves the added expense of additional fluid, pumping costs, and time. These added expenses may not be justified for small volume matrix acidizing treatments.

Additionally, for each incremental period, this computation method involves simulating a bottomhole pressure given the rate history up to that time, taking the difference between the calculated pressure and the measured pressure, and then calculating the observed skin factor, thus requiring more calculation steps than are necessary to generate a plot of skin factor versus time.

Accordingly, the present invention provides a novel matrix acidizing evaluation method which considers the effects of pumping rate variations, is fast, simple to implement, and can be performed in real-time. The method, therefore, provides a relatively quick and simple method for calculating formation skin factor during an acidizing operation.

SUMMARY OF THE INVENTION

The present invention provides a real-time matrix acidizing evaluation method based on the line-source solution to the radial-flow transient well testing problem. Skin factor is calculated directly from the measured bottomhole pressure response based upon a number of known input parameters for the well under treatment.

The major advantage of this method over the previous methods is that an initial value of skin factor is not needed. The present method uses small time/rate steps so that the change in skin factor over each step is small and can be assumed to be approximately constant, thereby maintaining the validity of the theoretical approach. Also, the present method avoids the problems of the steady-state assumption because it is based on transient pressure theory and thus the limitations of the steady-state pressure approach do not apply. Additional advantages of this method are ease of implementation, quick calculation time, and usefulness for both real-time and post-treatment evaluation.

BRIEF DESCRIPTION OF THE DRAWINGS

The invention will now be described in greater detail by way of example with reference to the accompanying drawing, in which.

DETAILED DESCRIPTION OF A PREFERRED EMBODIMENT

Figure 1:
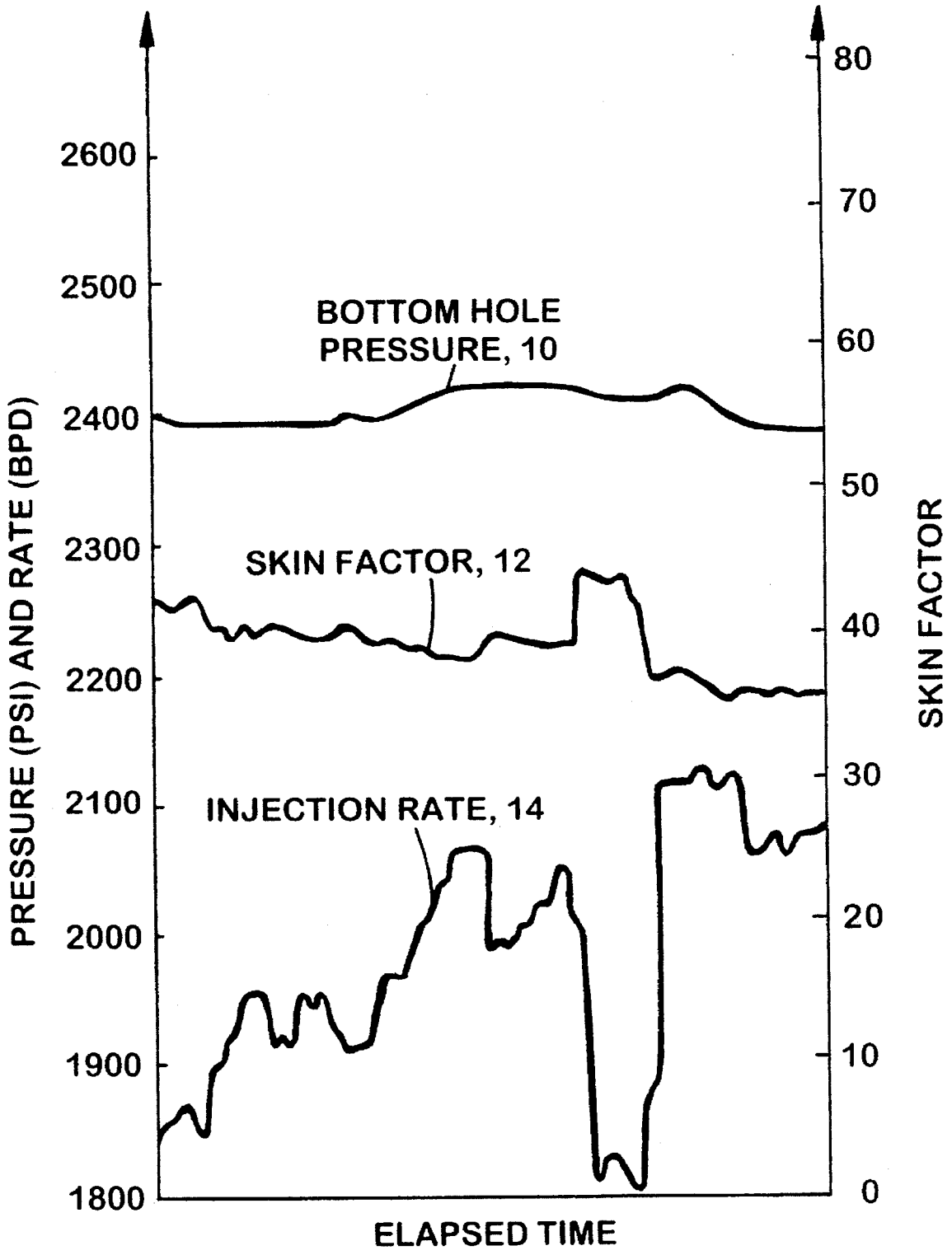
FIG. 1 shows the injection rate, bottomhole pressure, and skin factor evolution as a function of time.

The present method is based on the pressure transient theory which states that a change in pressure is indicative of a change in flow rate. In a preferred implementation of the invention, the following well parameters will be utilized for evaluation of the degree of improvement in well damage: formation permeability, formation porosity, injected fluid viscosity and compressibility, wellbore radius (hole size), formation thickness, initial or average reservoir pressure, and formation volume factor for the injected fluid. In addition to these reservoir and fluid parameters, the bottomhole pressure and the injection rate as a function of time are needed prior to beginning the evaluation. Injection rate data and bottomhole pressure data are generally acquired during the matrix acidizing treatment, examples of which are shown in FIG. 1. Each of the parameters needed to perform the evaluation are usually readily available from previously analyzed data. Best estimates of the parameters can also be used if accurate values from previous analyses are unavailable.

Once the above initial well parameters are known, the matrix acidizing treatment evaluation can begin. Treatment begins by injecting the treatment fluid into the formation. During the treatment process the injection rate of the treatment fluid is monitored. The injection rate is measured using on-site equipment, such as a flowmeter, or by other methods known to those skilled in the art. As the treatment fluid is injected into the formation, measurements of the surface pressure, $P_s$, are made at discrete time intervals. Using the measured surface pressure, the bottomhole pressure, $P_{\omega f}$, is determined for each time interval t by selecting one of several conventional, commercially available auxiliary processing methods, one example being ACQUIRE software marketed by Halliburton Energy Services of Dallas, Tex., which converts surface pressure to bottomhole pressure using fluid properties and the injection rate. Alternatively, if equipment is in place to provide real-time measurement of bottomhole pressure, such measurements can be utilized.

Once the bottomhole pressure is determined, a dimensionless pressure, $P_D$, can be calculated using the line source solution:

$$P_D(t_D) = -\frac{1}{2}\, Ei\left(-\frac{1}{4t_D}\right) \qquad \text{eq. 1}$$

The line source solution represents the pressure versus rate response as defined for a single well producing at constant rate in an infinite, horizontal, thin reservoir containing a single-phase, slightly compressible fluid. The dimensionless time, $t_D$ may be determined from the relation:

$$t_D = \frac{2.64\times 10^{-4} kt}{\phi\mu C_t r_\omega 2} \qquad \text{eq. 2}$$

where:

k represents the formation permeability;

t represents time;

$\phi$ represents the formation porosity;

$\mu$ represents the viscosity of treatment fluid;

$C_t$ represents the total system compressibility; and $r_\omega$ represents the wellbore radius.

The exponential integral:

$$Ei\left(-\frac{1}{4t_D}\right) \qquad \text{eq. 3}$$

may be evaluated through:

$$Ei(-x) = \int_{-x}^{\infty} \frac{e^{-u}}{u}\, du \qquad \text{eq. 4}$$

The exponential integral can be evaluated by one of several methods, however for the purposes of the present method, it is evaluated using polynomial approximations known to the art, and presented by Abramowitz and Stegun in the Handbook of Mathematical Functions, NBS, Applied Mathematics Series No. 55, Washington, D.C., 1972, p. 231; the disclosure of which is incorporated herein by reference to demonstrate the skill in the art.

The dimensionless pressure $P_D$ is calculated for various discrete times t. As each dimensionless pressure measurement is calculated, it is subtracted from the previous dimensionless pressure measurement and that difference is multiplied by the flow rate ($q_N$) recorded at the time of the current dimensionless pressure calculation. As time progresses, a summation of each of these dimensionless pressure difference calculations is multiplied by the reciprocal of the current injection rate ($q_N$). This summation is then used to calculate the skin factor S(t), such as through the relation:

$$S(t) = \frac{kh(P_{\omega f}(t) - P_i)}{141.2 q_N B u} + \frac{1}{q_N}\{q_1[P_D(t_D) - P_D([t-t_1]_D)] + q_2[P_D([t-t_1]_D) - P_D([t-t_2]_D)] + \ldots + q_{N-1}[P_D([t-t_{N-2}]_D) - P_D([t-t_{N-1}]_D)] + q_N[P_D([t-t_{N-1}]_D)]\} \qquad \text{eq. 5}$$

Where:

$P_i$ represents the initial reservoir pressure;

h represents the subterranean formation's vertical thickness;

B represents the formation volume factor which is a ratio of volume at reservoir conditions to volume at standard conditions and accounts for the change in fluid volume versus surface volume of the injected fluid; and u represents the viscosity of the injected fluid.

Using equation 5, treatment is continued until the skin factor 12 reaches some terminal value as shown in FIG. 1, indicating a flow enhancement as a result of the stimulation treatment.

With reference to FIG. 1, the bottomhole pressure 10 is maintained at an almost constant level during the matrix treatment. As the injection rate is increased, the skin factor 12 shows a steady decline from approximately 42 to 35. As can be seen in FIG. 1, sudden, dramatic changes in the injection rate 14 cause significant changes in the skin factor. The present method allows real time calculation of the changes in skin factor so that adjustments can be made in the stimulation treatment if necessary and treatment can be ceased when the skin factor reaches the desired level.

There are several pertinent assumptions upon which the present evaluation method is based. The first assumption is that the pressure at the well can be modeled using the line source solution and skin factor concept. This assumption is appropriate because fluid movement during a matrix acidizing treatment is essentially radial from the wellbore out into the reservoir, and the effect of near wellbore damage is commonly modeled using the skin factor concept. The line-source solution and the skin factor concept provide the simplest means of modeling the pressure versus time response of a matrix acidizing treatment while retaining the character of the well's actual pressure response.

The second assumption is that the formation permeability is constant. The reason for performing a matrix acidizing treatment is to remove damage from the near wellbore region. The damaging material is generally acid soluble, however the formation itself may or may not be acid soluble. Assuming that very little of the formation is dissolved by the acid, the assumption of constant formation permeability is valid. Further, the behavior of the pressure response due to dissolving the damaging material is attributed to changes in skin factor only. The pressure response due to changes in skin factor is usually of much greater magnitude than that occurring from small changes in permeability. Therefore, formation permeability can be assumed constant with no detrimental effects on the calculated skin factor.

Finally, wellbore storage effects are not considered in evaluating the skin factor as a function of time. This assumption is acceptable since the injected liquid is not very compressible and the injection rates are high thus rendering wellbore storage effects negligible.

As can be seen by reference to FIG. 1, the bottomhole pressure response corresponds to changes in the skin factor, thus the present method provides an accurate real-time measure of the effectiveness of the matrix acidizing treatment. By continuously updating the skin factor during the stimulation based on changes in pressure, the present method provides a real-time calculation of skin factor so that treatment can be adjusted accordingly.

What is claimed is:

1. A method for determining the effectiveness of a matrix acidizing treatment of a subterranean formation being penetrated by a wellbore, said method comprising the steps of:

(a) injecting a treatment fluid into said subterranean formation via said wellbore;

(b) measuring, by a flow rate detector, a treatment fluid flow rate value, said treatment fluid flow rate value representing said treatment fluid's flow into said subterranean formation;

(c) measuring, by a pressure detector, a surface pressure response value, said surface pressure response value representing the subterranean formation's surface pressure during the injection of said treatment fluid;

(d) determining a bottomhole pressure value, said bottomhole pressure value representing the wellbore's bottom pressure during the injection of said treatment fluid;

(e) determining a dimensionless pressure value for said wellbore;

(f) determining a skin factor value; and (g) comparing the determined skin factor value against a predetermined skin factor value to determine the effectiveness of said matrix acidizing treatment.

2. The method of claim 1 wherein said skin factor signal is generated in real-time.

3. The method of claim 1 wherein said determined bottomhole pressure value and said determined dimensionless pressure value are determined at a series of discrete time intervals and wherein said determined skin factor value is determined at each said time interval.

4. The method of claim 3 wherein said determined dimensionless pressure value is a summation of pressure differences between said determined bottomhole pressure values over a plurality of consecutive time intervals.

5. The method of claim 3 wherein said skin factor value is determined in accordance with the following relationship:

$$\frac{kh(P_{\omega f}(t)-P_i)}{141.2q_N Bu}+\frac{1}{q_N}\{q_1[P_D(t_D)-P_D(t-t_1)_D]+q_2[P_D(t-t_1)_D-P_D(t-t_2)_D]+\ldots+q_{N-1}[P_D(t-t_{N-2})_D-P_D(t-t_{N-1})_D]+q_N[P_D(t-t_{N-1})_D]\},$$

wherein, (a) k represents said subterranean formation's permeability value, (b) h represents said subterranean formation's vertical thickness, (c) $P_{\omega f}(t)$ represents said determined bottomhole pressure value at a time t, (d) $P_i$ represents said measured surface pressure value before said treatment fluid is injected, (e) B represents said formation's volume factor, (f) u represents said treatment fluid's viscosity, (g) $q_i$ represents said measured flow rate value at a specified point in time i, where i is an integer running from 1 to N and N represents the time of final measurement, (h) $P_D$ represents said determined dimensionless pressure value;

(i) t represents a current time value and $t_j$ represents the time value at measurement time j, where j is an integer running from 1 to N and N represents the time of final measurement, and (j) $t_D$ represents a dimensionless time value determined according to the following relationship:

$$\frac{kt(2.64\times10^{-4})}{2\,\phi\,\mu C_t\, r_\omega}$$

wherein (A) $\phi$ represents said subterranean formation's porosity, (B) $C_t$ represents said subterranean formation's compressibility, (C) $\mu$ represents said treatment fluid's viscosity, and (D) $r_\omega$ represents said wellbore's radius.

6. A method for determining the effectiveness of a matrix acidizing treatment, at a series of discrete time intervals, of a subterranean formation being penetrated by a wellbore, said method comprising the steps of:

(a) injecting a treatment fluid into said subterranean formation via said wellbore;

(b) measuring, by a flow rate detector, a treatment fluid flow rate value, $q_N$, said treatment fluid flow rate value representing said treatment fluid's flow into said subterranean formation;

(c) measuring, by a pressure detector, a surface pressure response value, said surface pressure response value representing the subterranean formation's surface pressure during the injection of said treatment fluid;

(d) determining a bottomhole pressure value, $P_{\omega f}$, at said series of discrete time intervals, said bottomhole pressure value representing the wellbore's bottom pressure during the injection of said treatment fluid;

(e) determining a dimensionless pressure value, $P_D$, for said wellbore at said series of discrete time intervals;

(f) determining, in real-time a skin factor value at said series of discrete time intervals, in accordance with the following relationship:

$$\frac{kh(P_{\omega f}(t)-P_i)}{141.2q_NBu}+\frac{1}{q_N}\{q_1[P_D(t_D)-P_D(t-t_1)_D]+q_2[P_D(t-t_1)_D-P_D(t-t_2)_D]+\ldots+q_{N-1}[P_D(t-t_{N-2})_D-P_D(t-t_{N-1})_D]+q_N[P_D(t-t_{N-1})_D]\},$$

wherein, (1) k represents said subterranean formation's permeability value, (2) h represents said subterranean formation's vertical thickness, (3) $P_{\omega f}(t)$ represents said determined bottomhole pressure value at a time t, (4) $P_i$ represents said measured surface pressure value before said treatment fluid is injected, (5) B represents said formation's volume factor, (6) u represents said treatment fluid's viscosity, (7) $q_i$ represents said measured flow rate value at a specified point in time i, where i is an integer running from 1 to N and N represents the time of final measurement, (8) t represents a current time value and $t_j$ represents the time value at measurement time j, where j is an integer running from 1 to N and N represents the time of final measurement, and (9) $t_D$ represents a dimensionless time value determined according to the following relationship:

$$\frac{kt(2.64\times10^{-4})}{2\phi\mu C_t r_\omega}$$

wherein (A) $\phi$ represents said subterranean formation's porosity, (B) $C_t$ represents said subterranean formation's compressibility, (C) $\mu$ represents said treatment fluid's viscosity, and (D) $r_\omega$ represents said wellbore's radius; and (g) comparing the determined skin factor value against a predetermined skin factor value to determine the effectiveness of said matrix acidizing treatment.

7. The method of claim 6 wherein said dimensionless pressure value is a summation of pressure differences between said generated bottomhole pressure values over a consecutive plurality of said series of discrete time intervals.

* * * * *